US006293824B1

(12) United States Patent
Guerin et al.

(10) Patent No.: US 6,293,824 B1
(45) Date of Patent: Sep. 25, 2001

(54) CONNECTOR ELEMENT FOR MOUNTING ON A ELECTRIC CABLE HAVING A HELICALLY-CORRUGATED OUTER CONDUCTOR, AND A METHOD OF MOUNTING IT

(75) Inventors: Maurice Guerin, Voiron; Jean-Marc Baffert, Charavines; Catherine Coste, Grenoble, all of (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 09/532,464

(22) Filed: Mar. 22, 2000

(30) Foreign Application Priority Data

Mar. 25, 1999 (FR) ..... 99 03741

(51) Int. Cl.[7] ..... H01R 9/05
(52) U.S. Cl. ..... 439/583
(58) Field of Search ..... 439/583, 584, 439/578

(56) References Cited

FOREIGN PATENT DOCUMENTS

| | | |
|---|---|---|
| 0495467 | 1/1992 | (EP) . |
| 0551092 | 1/1993 | (EP) . |
| 0629025 | 6/1994 | (EP) . |
| 2303749 | 2/1997 | (GB) . |

*Primary Examiner*—Khiem Nguyen
*Assistant Examiner*—Javaid Nasri
(74) *Attorney, Agent, or Firm*—Schweitzer Cornman Gross & Bondell LLP

(57) ABSTRACT

The invention relates to a connector element for mounting on an electric cable comprising at least an inner conductor and a helically-corrugated outer conductor, said element comprising a body and a ring suitable for being secured to the body by screwing, and having a tapped segment for screwing the ring onto the helically-corrugated outer conductor of the cable, and a tapped segment for securing the ring to the body by screw engagement. The tapped segments of the ring have oppositely-handed screw threads such that screwing the body into the ring, while the ring is prevented from rotating, causes the body and the cable to move towards each other.

5 Claims, 3 Drawing Sheets

CONNECTOR ELEMENT FOR MOUNTING ON A ELECTRIC CABLE HAVING A HELICALLY-CORRUGATED OUTER CONDUCTOR, AND A METHOD OF MOUNTING IT

The present invention relates to an electrical connector element for mounting on an electric cable, and to a method of mounting it.

More particularly, the invention relates to connector elements which are for mounting on cables having a helically-corrugated outer conductor.

In the present description, the term "helically-corrugated conductor" is used to mean a tubular conductor having corrugations whose peaks follow helixes around the axis of the cable, said corrugations forming a thread around the outer conductor of the cable.

BACKGROUND OF THE INVENTION

Coaxial connector elements are already known that are designed to be mounted at the ends of such cables. Thus, for example, the connector element described in U.S. Pat. No. 5,154,636 comprises a body supporting a central contact which is held by insulation on the axis of the connector element, a ring which is organized to be capable of being screwed onto the helically-corrugated outer conductor of the cable, and a washer that is interposed between the body and the ring. The body and the ring can screw together to enclose the washer to constitute the connector element.

The ring has a frustoconical mouth directed towards the body and the washer has a frustoconical surface that is complementary to said mouth.

After the ring has been screwed onto the cable, the outer conductor passes through the ring and its end is in register with the frustoconical mouth of the ring. By using a suitable tool, this end is flared so as to be pressed against said mouth.

The washer is then pressed against the ring, with its frustoconical surface clamping the flared end of the outer conductor against the frustoconical mouth of the ring, after which the body is screwed to the ring, thereby compressing the washer against the ring and permanently locking the connector element to the outer conductor of the cable, and thus to the cable itself, while also connecting the inner conductor of the cable to a pin that is secured to the central contact of the body.

The function of the washer is to prevent the body from causing the cable to rotate while the outer conductor is being clamped, since that could cause the cable to become unscrewed in the ring.

Such a connector element gives satisfaction as to its electrical characteristics.

However, it gives rise to a large number of handling operations which make it lengthy and fiddly to put into place at the end of a cable.

The connector element is initially supplied in the assembled condition, thereby guaranteeing that all of its component parts are present, and protecting these parts during transport, however the connector element then needs to be disassembled in order to be mounted on a cable, and such mounting is performed on site.

To sum up, for mounting purposes, it is necessary to take apart the connector element, to screw the ring onto the outer conductor, to flare the end thereof, to put the washer into place, and to screw the body to the ring.

OBJECTS AND SUMMARY OF THE INVENTION

The present invention seeks to simplify such a connector by minimizing the number of component parts and also the number of operations that need to be performed to mount it on the end of the helically-corrugated outer conductor of a coaxial cable.

The present invention provides a connector element for mounting on an electric cable having at least an inner conductor and a helically-corrugated outer conductor, said connector element comprising:

- a body supporting at least one internal contact held by insulation in the vicinity of the axis of the connector element; and
- a ring having a tapped first segment for securing the ring to the body by screw engagement, and a second tapped segment whereby said ring can be screwed on the helically-corrugated outer conductor of the cable, causing an end segment thereof to project towards the body, thereby holding the cable in alignment with the connector element so that the outer conductor of the cable is electrically connected to the body and the inner conductor(s) of the cable is/are electrically connected to the internal contacts of the body,
- the body and the ring being organized in such a manner that screwing one to the other causes the end segment of the outer conductor to be clamped against the mouth of the tapped second segment of the ring,
- wherein the tapped segments of the ring have screw threads that are oppositely-handed relative to each other, such that screwing the body into the ring while the ring is prevented from rotation causes the body and the cable to be move towards each other.

It will be understood that in accordance with the invention the screw tightening direction between the body and the ring is opposite from the screw tightening direction between the ring and the cable.

The connector element of the invention thus provides a simple and low cost solution to the requirements stated above.

Because the screw tightening directions are reversed firstly between the ring and the body and secondly between the cable and the ring, if the body causes the cable to rotate while it is being screwed to the ring, that can only serve to tighten the ring to the cable and thus increase the clamping on the end of the cable between the body and the ring.

Consequently, the invention makes unnecessary the washer which used to be interposed between the prior art connector elements.

In addition, the operator installing the connector element of the invention at the end of a coaxial cable does not need to pay attention to any risk of one part loosening relative to another while the connector element is being assembled.

In a particular embodiment of the invention, the ring and the body leave sufficient space between them when they begin to be screwed together for receiving a plurality of turns of the helically-corrugated outer conductor of the cable.

Thus, when the ring is screwed to the cable, a plurality of turns of the outer conductor project from the mouth of the ring, and these turns are held captive between the ring and the body and are pressed one against another when the ring is screwed to the body, thereby providing retention means for the cable and making it unnecessary to use a special tool for flaring the end of the conductor in the mouth of the ring.

Advantageously, a frustoconical projection is provided which is preferably carried by the body at its rear end, in register with the mouth of the second tapped segment of the ring, said projection being pushed back against said mouth when the body is screwed into the ring.

The present invention is particularly, but not exclusively, well suited to being applied to connector elements that are coaxial in structure.

The present invention also provides a method of mounting an electrical connector element as described above on a cable comprising at least an inner conductor and a helically-corrugated outer conductor, said connector element including a frustoconical projection, preferably carried by the body at its rear end, in register with the mouth of the second tapped segment of the ring, said method consisting in:

screwing the body into the ring while leaving sufficient space between the frustoconical projection and the mouth of the second tapped segment to receive an end segment of the outer conductor of the cable;

screwing the assembly made up in this way onto the outer conductor of the cable until an end segment of the cable projects beyond said ring between the ring and the body; and screwing the body into the ring while preventing the ring from rotating, thereby causing the body and the cable to move towards each other.

It will be understood that this method is easily implemented since, because of the invention, there is no risk of the cable unscrewing from the ring while the body is being screwed to the ring, even if, by friction, the body causes the cable to rotate.

BRIEF DESCRIPTION OF THE DRAWINGS

In order to make the invention better understood, there follows a description of an embodiment given by way of non-limiting example and with reference to the accompanying drawings, in which.

MORE DETAILED DESCRIPTION

Figure 1:
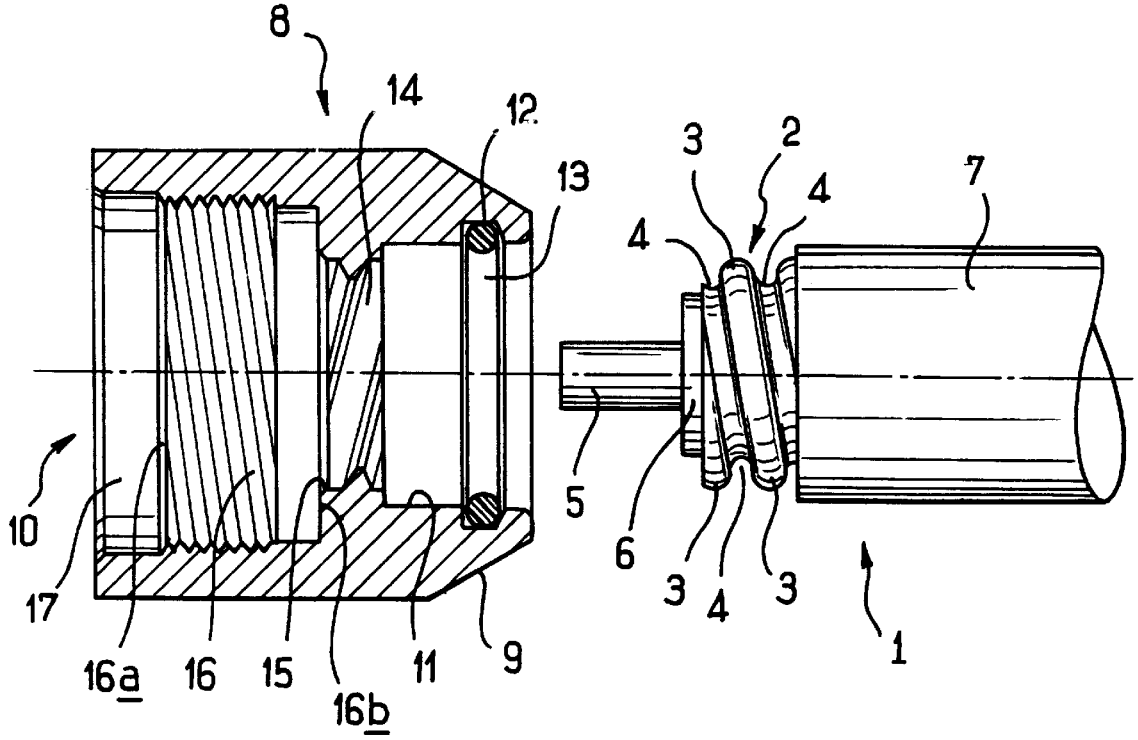
FIG. 1 is an axial section view of a ring and of a coaxial cable.

FIG. 1 shows a coaxial cable 1 having an outer conductor 2 that is helically-corrugated, i.e. that is constituted by a metal tube which has been subjected to an operation for forming corrugations whose peaks 3 describe helixes by being separated by furrows 4, thereby constituting a thread having a right-hand pitch.

The outer conductor 2 is separated from the inner conductor 5 by insulation 6.

The assembly is covered in a sheath of plastics material 7.

The ring 8 which is shown facing the cable is substantially cylindrical in shape and is provided with a chamfer 9 in its rear face.

Figure 3:
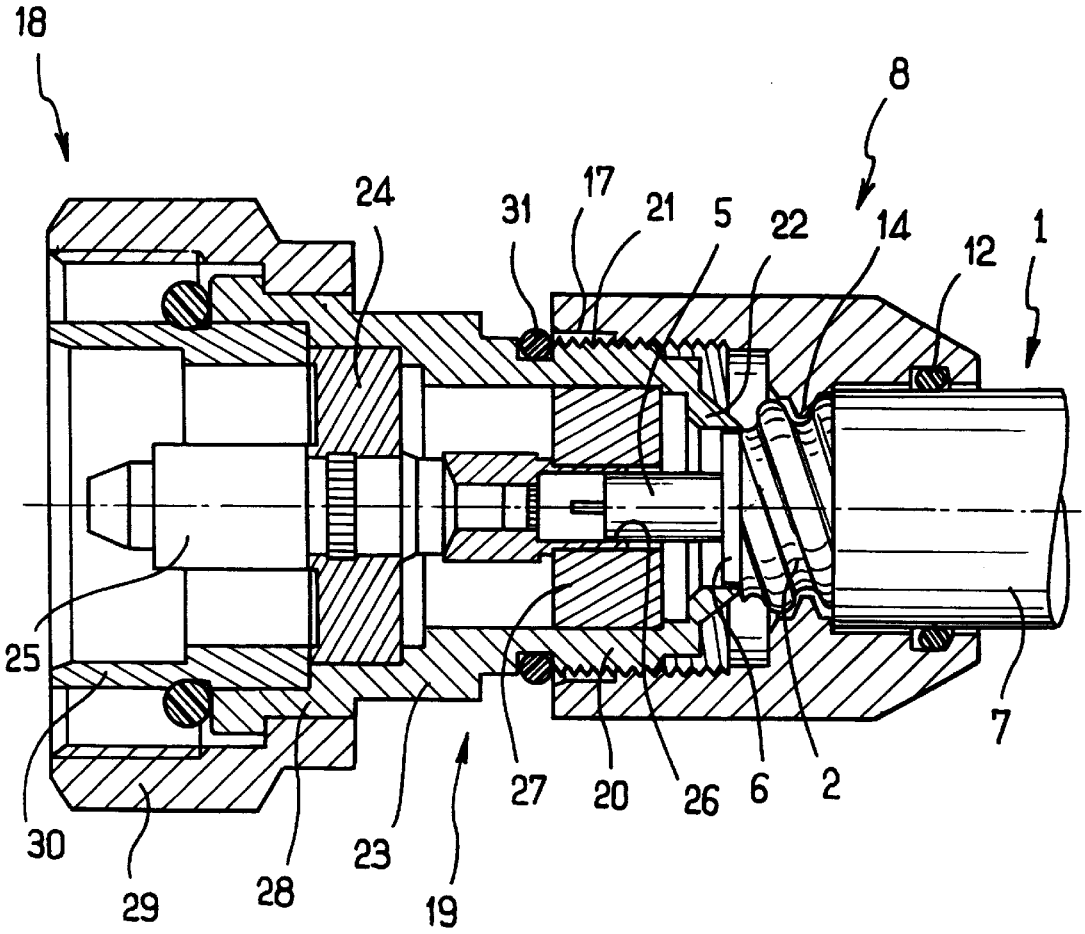
FIG. 3 is an axial section view of the ring and of the cable, together with a body, prior to the ring and the body being screwed together.
Figure 4:
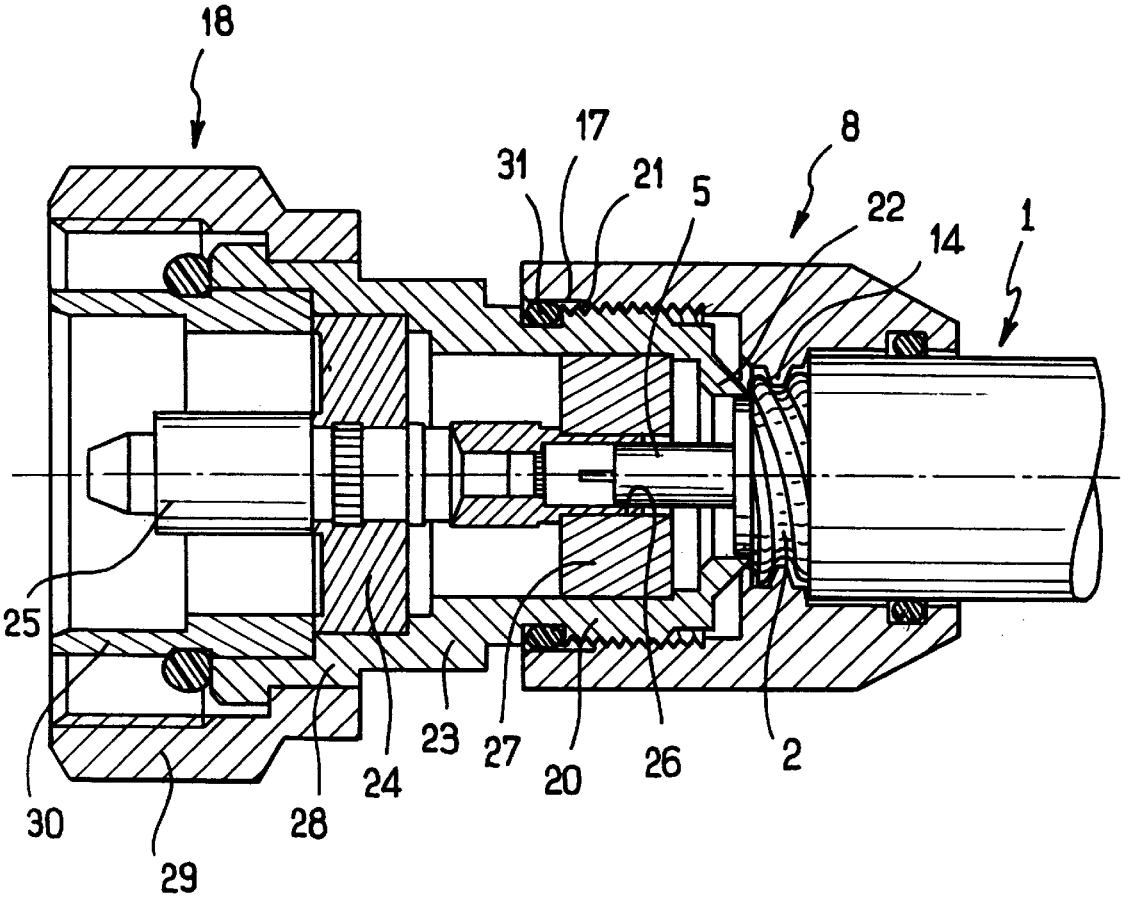
FIG. 4 is a view analogous to FIG. 3, after the ring and the body have been screwed together.

The ring 8 has a passage 10 passing axially therethrough, which passage presents various segments that are described below in succession from the rear end towards the front end of the ring, specifically:

a rear first segment 11 for receiving the sheathed portion of the coaxial cable 1. This segment 11 is provided with an annular groove 12 housing an O-ring 13 which, by pressing against the sheath 7, serves to provide sealing between the inside and the outside of the connector element;

a second segment 14 of smaller diameter and tapped at the same pitch as the outer conductor of the cable, and terminated at the front by a mouth 15;

a segment 16 of larger diameter and designed to receive the body of the connector element, as shown in FIGS. 3 and 4. This segment is tapped over the major fraction of its length from its front end 16*a* to the vicinity of its rear end 16*b*; and a front segment 17 corresponding to a bore of the preceding segment 16. This bore is designed to receive a sealing ring carried by the body.

Figure 2:
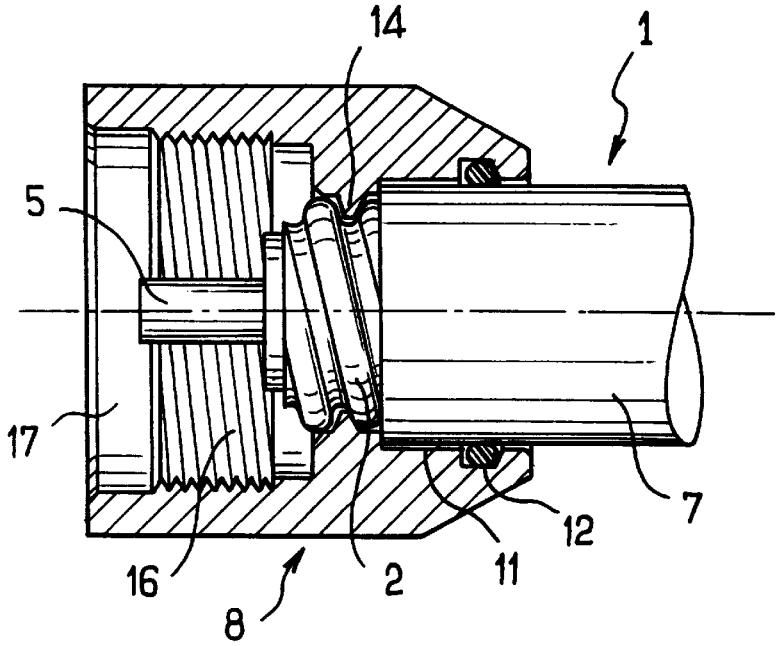
FIG. 2 is a view analogous to FIG. 1 showing the ring screwed onto the cable.

As can be seen in FIG. 2, the ring 8 is screwed onto the outer conductor 2 of the cable by means of the tapping in its tapped segment 14, and this is continued until the sheath 7 of the cable comes into abutment against the end wall of the segment 11 of the ring.

The ring is left in this position on the cable and the body 18 is presented facing the ring 8.

The body is shown in FIG. 3 where it can be seen that it comprises a hollow body of revolution 19 having a plurality of cylindrical portions going from its rear towards its front.

A first portion 20 of the body has an outside thread 21 suitable for screw engagement in the tapped segment 16 of the ring 8.

On the rear face of the body, this portion 20 is terminated by a frustoconical projection 22 whose small diameter lies between the inside diameter and the outside diameter of the outer conductor 2 of the cable.

The flare angle of the outer surface of said frustoconical projection 22 is such that said projection can penetrate into the mouth 15 of the tapped segment 14 of the ring.

A second portion 23 of the body has a diameter that is slightly greater than the diameter of the preceding portion. This portion 23 contains insulation 24 which carries an inner conductor 25 of shape that is not described in detail herein, which conductor is secured to a socket 26 that faces towards the rear of the body, i.e. towards the cable, said socket 26 being likewise supported by insulation 27 received in the first segment 20 of the body.

The third and last portion 28 of the body has an even larger diameter. It supports a clamping ring 29 and a ground contact 30 for connection with an additional connector element (not shown).

In the position shown in FIG. 3, the body 18 is screwed in part only into the ring 8. The tip of the frustoconical projection 22 of the body has come into contact with the front end of the outer conductor 2 of the cable.

The body 18 penetrates into the ring 8 by left-hand screwing, i.e. in the opposite direction for screwing the cable into the ring.

Consequently, even when the body has reached the position shown in FIG. 3, where the frustoconical projection 22 has come into contact with the outer conductor 2, in which position said body can rotate the cable by friction, there is no risk of the cable becoming unscrewed and escaping from the ring, and on the contrary it can only become screwed more tightly in the ring.

As a result, the operator does not need to pay attention to the behavior of the cable while tightening the body. All the operator needs to do is hold the ring so as to prevent it from rotating.

As can be seen in FIG. 4, screwing the body into the ring causes the end of the outer conductor to be compressed between the frustoconical projection 22 of the body and the mouth 15 of the ring. When its turns are compressed in this way, they are moved towards one another, thereby finally locking the cable in the connector element.

In the method of the invention, it is possible to preassemble the connector element by initially screwing the body 18 in the ring 8 until the O-ring 31 carried by the body penetrates into the bore 17 of the ring.

In this position, there remains a space between the frustoconical projection 22 and the mouth 15.

The O-ring 31 then acts as a brake, preventing the ring from coming unscrewed from the body.

The assembly constituted in this way can then be screwed onto the outer conductor of the cable, with the end thereof being received between the projection 22 and the mouth 15.

When resistance begins to be felt, that means that the front end of the outer conductor has come into abutment against the projection 22.

All that then remains to be done is to hold the ring 8 and tighten the body therein, thereby clamping the end of the cable between the projection and the mouth 15. The O-ring 31 remains in the bore 17 and provides sealing between the inside and the outside of the connector element.

Naturally, the embodiment described above is not limiting in any way and could receive any desirable modification without thereby going beyond the ambit of the invention as defined by the claims.

In particular, although the example relates to a coaxial connector element, the invention can be applied to any type of electrical connector having outer shielding constituted by a helically-corrugated outer conductor, in particular a multicontact connector, with this being made easier by the invention since the ring can be clamped to the body as to the cable by preventing the body and the cable from rotating and causing only the ring to rotate.

What is claimed is:

1. A connector element for mounting on an electric cable with an end segment having at least an inner conductor and a helically-corrugated outer conductor, said connector element comprising:

a body supporting at least one internal contact held by insulation in the vicinity of the axis of the connector element; and a ring having a tapped first segment for securing the ring to the body by screw engagement, and a second tapped segment defining a mouth whereby said ring can be screwed on the helically-corrugated outer conductor of the cable, causing said end segment thereof to project towards the body, thereby holding the cable in alignment with the connector element so that the outer conductor of the cable is electrically connected to the body and the inner conductor(s) of the cable is/are electrically connected to the internal contacts of the body, the body and the ring being organized in such a manner that screwing one to the other causes the end segment of the outer conductor to be clamped against said mouth of said tapped second segment of the ring, wherein the tapped segments of the ring have screw threads that are reversely threaded relative to each other, such that screwing the body into the ring while the ring is prevented from rotation causes the body and the cable to move towards each other.

2. The connector element according to claim 1, wherein a frustoconical projection in registry with said mouth of the tapped second segment of the ring and said projection is engaged against said mouth when the body is screwed into the ring.

3. The connector element according to claim 2, wherein the frustoconical projection is carried by the body.

4. The connector element according to claim 1, the element being coaxial in structure.

5. A method of mounting an electric connector element on a cable having an end segment with at least an inner conductor and a helically-corrugated outer conductor, said connector element being made in accordance with claim 2, and said method consisting of:

screwing together the body and the ring while leaving sufficient space between the frustoconical projection of the body and the mouth of the tapped second segment to receive the end segment of the outer conductor of the cable;

screwing the assembly made up in this way onto the outer conductor of the cable until the end segment of the cable projects beyond the ring between the ring and the body; and screwing the body into the ring while preventing the ring from rotating, thereby causing the body and the cable to move towards each other.

* * * * *